United States Patent [19]

Haven

[11] 4,435,030

[45] Mar. 6, 1984

[54] BAR SOAP HOLDER AND DISPENSER

[76] Inventor: James T. Haven, 537 N. Clark St., Orange, Calif. 92667

[21] Appl. No.: 283,206

[22] Filed: Jul. 14, 1981

[51] Int. Cl.[3] ..... A47K 5/08

[52] U.S. Cl. ..... 312/351; 206/77.1; 248/309 R; 312/35

[58] Field of Search ..... 221/289, 303, 312 R; 232/64, 65, 66; 312/35, 42, 351; 248/309 R; 206/77.1

[56] References Cited

U.S. PATENT DOCUMENTS

| | | | |
|---|---|---|---|
| 211,131 | 1/1879 | Bruce | 232/66 |
| 1,872,816 | 8/1932 | Ringland | 206/77.1 |
| 1,889,501 | 11/1932 | Schnake | 312/351 |
| 2,370,747 | 3/1945 | Negbaur et al. | 221/289 X |
| 2,417,365 | 3/1947 | Jodoin | 312/351 |
| 2,596,675 | 5/1952 | Goissi | 206/77.1 |
| 2,768,048 | 10/1956 | Schumacher | 312/351 |
| 2,879,622 | 3/1959 | Graziano | 206/77.1 |
| 3,054,211 | 2/1961 | Hawk et al. | 312/351 |
| 4,313,537 | 2/1982 | Collet | 248/309 R |
| 4,392,630 | 7/1983 | Moontasir | 248/309 R |

FOREIGN PATENT DOCUMENTS

| | | | |
|---|---|---|---|
| 24392 | of 1906 | United Kingdom | 221/289 |

*Primary Examiner*—William E. Lyddane
*Assistant Examiner*—Joseph Falk
*Attorney, Agent, or Firm*—Fischer, Tachner & Strauss

[57] ABSTRACT

There is disclosed a soap bar holding and dispensing device which comprises a housing having a top, sidewalls and an open bottom with a soap bar rack pivotally mounted within the housing. The rack is formed by at least one leg having a distal, laterally projecting foot which, when the arm swings to a closed position, engages beneath the soap bar to secure the bar within the housing. The housing also includes at least one rib on an inside sidewall in juxtaposition to the leg and projecting to the leading edge of the foot when the rack is pivoted into its open position, thereby stabilizing the soap bar when the rack is moved to its open position and permitting the soap bar to fall from the dispensing device into one's hand.

10 Claims, 7 Drawing Figures

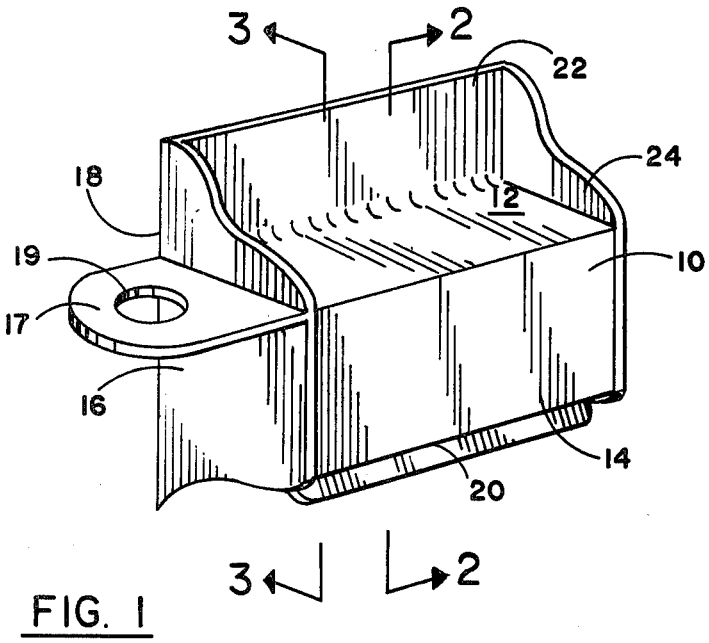
FIG. 1
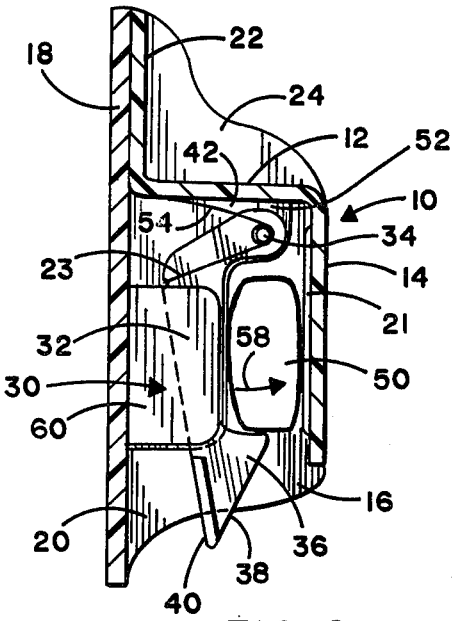
FIG. 2
FIG. 3
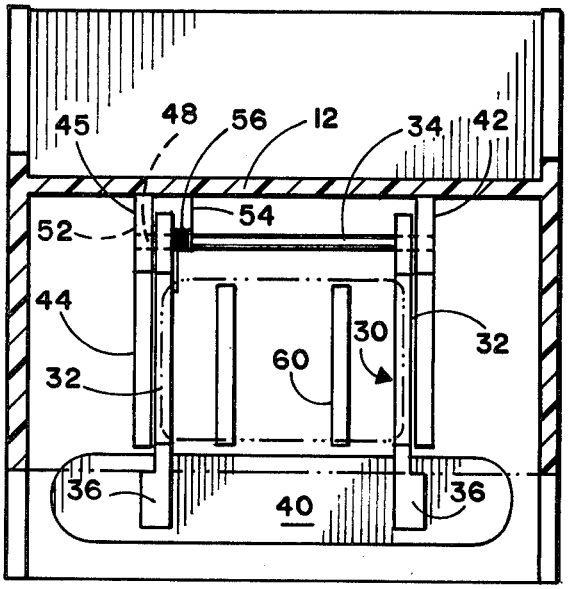
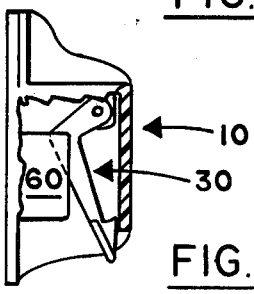
FIG. 4
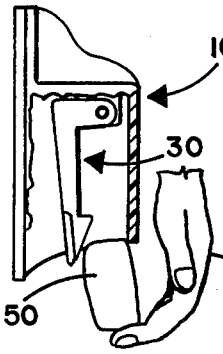
FIG. 5
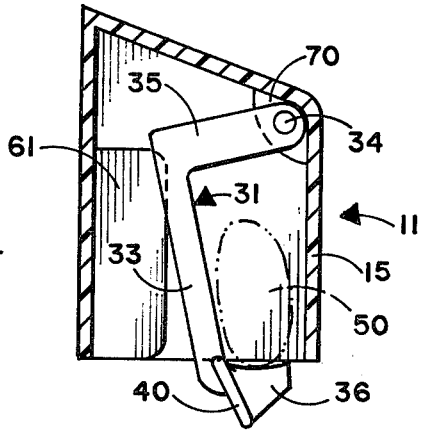
FIG. 7
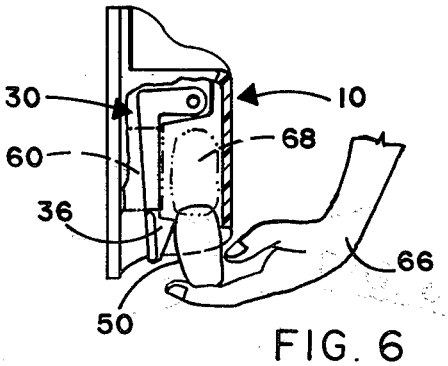
FIG. 6

BAR SOAP HOLDER AND DISPENSER

BACKGROUND OF THE INVENTION

1. Field of the Invention

This invention relates to a soap bar holding and dispensing device and in particular, to such a device suitable for the use in shower stalls, wash basins, and the like.

2. Restatement of the Prior Art

Various soap shelves and boxes have been designed for use in shower stalls, however, heretofore all the prior devices have suffered from one or more major disadvantages. The most common soap holder for showers is a metal or ceramic recessed shelf which is inset in the shower wall. While these uncovered shelves provide ease of access to the soap, they do not protect the soap from water sprays and splashes and a substantial amount of the soap is dissolved and wasted as well as contributing to an unsightly condition. This problem is not solved by covered shelves since the latter are often too difficult to use particularly when one's eyes are closed or blinded by soap irritation.

BRIEF STATEMENT OF THE INVENTION

This invention comprises a soap bar holding and dispensing device which protects and shelters the soap bar from water sprays and splashes and which, nevertheless, can be used by sense of touch alone, without need for visual observation. The invention comprises a housing having a closed top and sidewalls, and an open bottom. A soap rack is pivotally mounted within the housing on a pivot axis located in the upper portion of the housing. The soap rack is formed by at least one leg that extends downwardly from the pivot point and that has a distal, laterally projecting foot. The rack is resiliently biased to a closed position in which the foot engages beneath a soap bar inserted into the housing. The device also includes at least one rib mounted on an inside sidewall of the housing in juxtaposition to the leg which serves to stabilize or immobilize the soap bar in the housing, permitting the user to readily extract the soap by pivoting the rack to its open position, retracting the foot from beneath the soap bar and permitting the soap bar to fall from the housing, into one's hand.

BRIEF DESCRIPTION OF THE DRAWINGS

The invention will be described with reference to the figures of which:

FIG. 1 is a prespective view of the soap bar holding and dispensing device;

FIG. 2 is a sectional elevational view along lines 2—2 of FIG. 1;

FIG. 3 is a sectional view along lines 3—3 of FIG. 1;

FIG. 4 is a side view of the device in an empty condition;

FIG. 5 illustrates the insertion of a soap bar into the device;

FIG. 6 illustrates the dispensing of a stored soap bar from the device; and

FIG. 7 is a sectional elevational view of another embodiment of the invention.

DESCRIPTION OF THE PREFERRED EMBODIMENTS

Referring to FIG. 1, the invention comprises a soap bar holding and dispensing device that is defined by the housing 10 and that can be mounted onto a vertical or vertically inclined wall such as the wall of a shower stall. This housing has a closed upper or top surface 12 with a forward wall 14, and sidewalls such as 16 and a rear wall 18. The bottom 20 of the device is open. In the preferred embodiment, the top wall 12 is substantially horizontal, thereby providing a shelf for storage of cosmetics and sundries such as shampoo bottles and the like. Preferably the top wall has a slight forward incline to ensure drainage. The rear wall 18 can project above the top wall 12 providing an upper portion 22 and, if desired, the end walls such as 16 can also project above top wall 12 to provide upper end portions such as 24 for retention of items placed on the top wall 12. One or more side shelves such as 17 can be provided and these can have an aperture 19 to receive a wash cloth, brush handle and the like.

Referring now to FIG. 2, the internal construction of the soap holding and dispensing device of the invention will be described in greater detail. As there illustrated, the device 10 has an open bottom 20 and a soap rack 30 is pivotably mounted therein. The soap rack has at least one leg 32 that is pivotably mounted at its upper end in the housing on pivot shaft 34 and that has, at its opposite, lower end, a distal, laterally projecting foot 36. The lower end of leg 32 and foot 36 is preferably bevelled as shown at 38 and a cross bar 40 is preferably mounted at the lower end of leg 32.

The construction of the soap rack and its pivotal support in the housing can be better understood by reference to FIG. 3. As there shown, the rack 30 has two, parallel and spaced-apart legs 32 with a cross bar 40 attached to their lower ends. Each of these legs has a distal, lower foot 36 which, preferably has an expanded width as shown. The two legs 32 are mounted on a pivot shaft 34 which is supported in the housing on the stationary ribs 42. Stationary ribs 42 extend downwardly from the underside of the top 12. At their upper ends, the stationary ribs 42 extend a substantial distance across the housing 10 as shown in FIG. 2 while the lower portions 44 of these ribs 42 are of reduced depth to provide the clearance within the housing for insertion of the soap bar 50. Shaft 34 extends through apertures 48 in the upper portions 45 of the stationary ribs 42 and is secured therein. Preferably, ribs 42 each have a slot 52 which extends downwardly from their upper edges of the ribs 42 and which receive the ends of shaft 34. A spring wire 54 is provided on the assembly to bias the rack into a closed position in the direction of the arrowhead line 58, shown in FIG. 2. The spring wire 54 can include a helically wound portion 56. One or more of these helical springs or other springs such as leaf springs can be provided, as necessary.

One or more stationary ribs 60 projecting from the rear wall 18 interiorly of the housing can also be provided. These ribs are substantiallly rectangular in profile as shown in FIG. 2 and have a width which is sufficient to permit accommodation of a soap bar 50 within the interior chamber of housing 10. The ribs ensure dislodgement of the soap bar from rack 30 when the latter is swung to its open position. Preferably, narrow ribs 21 are also provided on the inside face of front wall 14 to limit the area of the housing surfaces which contact the soap bar.

Referring now to FIGS. 4 through 6, the operation and use of the soap bar holding and dispensing device will be described. As illustrated in FIG. 4, the device is shown in its empty position, with the rack 30 in a closed or forward position. This rack assumes this position when there is no soap within the device or when the soap bar has been reduced in thickness to a small size. As shown in FIG. 5, the rack 30 readily pivots to its open position when a soap bar 50 is placed underneath the housing and urged upwardly by one's hand 66 or opened by the back of one's fingertips pushing against cross bar 40. The beveled lower end 38 of the rack 30 transmits a sidewise or lateral force to the rack when the soap bar 50 is urged upwardly into the device, moving the rack 30 into its open position and permitting insertion of the soap bar 50.

When one wishes to extract the soap bar, one places one's hand beneath the dispensing device 10 in the manner shown in FIG. 6 and presses against the lateral cross bar 40 with one's fingers. This causes the rack 30 to swing to its open position, moving the lateral feet 36 into a recessed position between the leading edges of the stationary ribs 60 and 42. The soap which is in the position shown by the rectangle 68 in phantom lines is thus free to fall from the chamber within the housing into the palm of one's hand 66 in the illustrated manner.

Referring now to FIG. 7, the soap bar rack can be constructed as shown therein, to avoid the use of springs. In this embodiment, the pivot shaft 34 is positioned adjacent the inside of the front wall 15 with its ends received in stationary ribs 70 that are located at the top, forward inside corner of the housing 11. Each leg 33 has a dependent lateral upper arm 35 that extends forward of foot 36. This provides a counter weight effect which biases the soap rack 31 to its forward-most or closed position, without the need for resilient springs. Ribs 61 can be provided to dislodge the soap bar 50 from the rack when the latter is swung to an open position.

The device of the invention thus provides for the sheltered storage of a soap bar in which the soap bar is isolated from exposure to water sprays and splashes. The soap can, however, be readily inserted and extracted from the device by the simple manipulation of the rack 30 with the user applying force to the rack by the insertion of the soap or by one's fingertips forceably engaged against the lateral cross bar 40. After only a few attempts, a user can obtain the kinesthetic feeling of the operation of the device and can insert and extract the soap without visually observing the device and without the need to remove or swing open a protective covering. Since the device has only limited contact with the soap bar, there is little or no tendency to wear away the soap bar. Since the interior housing of the device is entirely sheltered from contact with water, there is substantially no loss of the stored soap by water sprays and splashes.

The entire device can be formed of plastic or metal parts, preferably it is formed of injection molded plastics such as, high density polyethylene, polyvinyl chloride and the like. When formed of metal, the exterior surfaces of the device can be provided with a polished surface or covered with ceramic tile. The housing can also be an integral porcelain casting. If desired, the device can be provided with a plurality of soap holding and dispensing racks such as 30 disposed in a side to side array, thereby providing one with a selection of various soap bars. While primarily intended for use within a shower or adjacent a bath, the holding and dispensing device can also be used adjacent a wash basin or wash counter, providing an attractive alternative to the common and often unsightly soap dish.

Since the entire bottom of the device is open, it can be readily cleaned by spraying the interior with a water spray and permitting the water and washings to drain from the open bottom housing. Any soap deposits on the rack 30 or on the interior stationary ribs within the housing do not present an unsightly appearance since the interior chamber of the housing is obscured from view and cleaning of the interior of the housing need only be practiced intermittently, as necessary to remove any soap deposits that could interfere with operation of the device. The device will readily accept and hold soap bars of all thicknesses, from the thickest bath soap bars available to thin slivers of used bars since the rack readily swings, under a resilient bias, into its most forward position, as shown in FIG. 4. Even small slivers of soap can be readily extracted from the device since the stationary ribs 60 and 44 will readily discharge even the thinest slivers of soap from the rack when the latter is pivoted into its open position.

The invention has been described with reference to the illustrated and presently preferred embodiment thereof. It is not intended that the invention be unduly limited by this disclosure of the presently preferred embodiment. Instead, it is intended that the invention be defined by the means, and their obvious equivalents, set forth in the following claims.

What is claimed is:

1. A soap bar holding and dispensing device which comprises:
   (a) a housing having a closed top, sidewalls and an open bottom;
   (b) a soap bar rack within said housing having at least one vertical leg with a distal, lateral projecting foot to receive a bar of soap, pivotably mounted at its upper end to the upper portion of said housing contained completely within said sidewalls and projecting through said open bottom;
   (c) at least one rib on a first inside sidewall of said housing in juxtaposition to said leg and projecting substantially to the leading edge of said foot when said rack is pivoted into an open position, towards said first wall to dislodge a bar of soap received on said foot for fall from said housing; and
   (d) biasing means urging said soap bar rack to a closed position away from said rib; whereby said rack can be swung open to dispense a received soap bar or to receive a soap bar, and released to close with said foot beneath said soap bar, securing said bar in said device.

2. The device of claim 1 wherein said rack has a plurality of parallel, spaced-apart legs and a like plurality of feet, dependent therefrom.

3. The device of claim 2 including a plurality of said ribs projecting between said legs.

4. The device of claim 1 wherein said biasing means comprises a wire spring biased between a housing wall and said rack.

5. The device of claim 1 wherein said foot has a bevelled lower end whereby an upward force applied to said bevelled end pivots said rack into an open position.

6. The device of claim 4 wherein said rack has a plurality of parallel, spaced-apart legs and a like plurality of feet, dependent therefrom.

7. The device of claim 6 including a plurality of said ribs projecting between said legs.

8. The device of claim 1 wherein said housing has a flat top to provide an exterior shelf.

9. The device of claim 1 for holding and dispensing a plurality of soap bars and including a plurality of said soap bar racks disposed side-by-side in said housing.

10. The device of claim 1 including a plurality of vertical ribs on the inside sidewall opposite said first inside sidewall.

* * * * *